United States Patent [19]

Murch et al.

[11] 4,358,899

[45] Nov. 16, 1982

[54] FLOW-THROUGH DRYER AND METHOD FOR RAPID DRYING OF POROUS FOAMS

[75] Inventors: Robert M. Murch, Brinkwood, Md.; John J. Eagan, Acton, Mass.

[73] Assignee: W. R. Grace & Co., New York, N.Y.

[21] Appl. No.: 249,182

[22] Filed: Mar. 30, 1981

[51] Int. Cl.[3] ..... F26B 3/06

[52] U.S. Cl. ..... 34/15; 34/229; 34/233; 34/242

[58] Field of Search ..... 34/225, 233, 223, 230, 34/231, 229, 242, 15, 23

[56] References Cited

U.S. PATENT DOCUMENTS

| | | | |
|---|---|---|---|
| 2,157,975 | 5/1939 | Wilson | 34/225 |
| 2,549,619 | 4/1951 | Miskella | 34/233 |
| 3,897,372 | 7/1975 | Kehr et al. | 521/122 |
| 3,899,836 | 8/1975 | Johnson | 34/225 |
| 4,066,578 | 1/1978 | Murch et al. | 521/123 |
| 4,137,200 | 1/1979 | Wood et al. | 521/159 |
| 4,165,411 | 8/1979 | Marans et al. | 521/107 |
| 4,230,822 | 10/1980 | Murch et al. | 521/123 |

*Primary Examiner*—Larry I. Schwartz

*Attorney, Agent, or Firm*—Edward J. Cabic; Richard P. Plunkett; William W. McDowell, Jr.

[57] ABSTRACT

A drying chamber for water laden foams supports the foam structure on a porous support and warm air is forced through the foam to dry it. An air impervious mask on the porous support around the object insures that all the air only flows through the object. Multiple objects can also be dried and loaded outside the drying chamber.

12 Claims, 3 Drawing Figures

FIG. 1
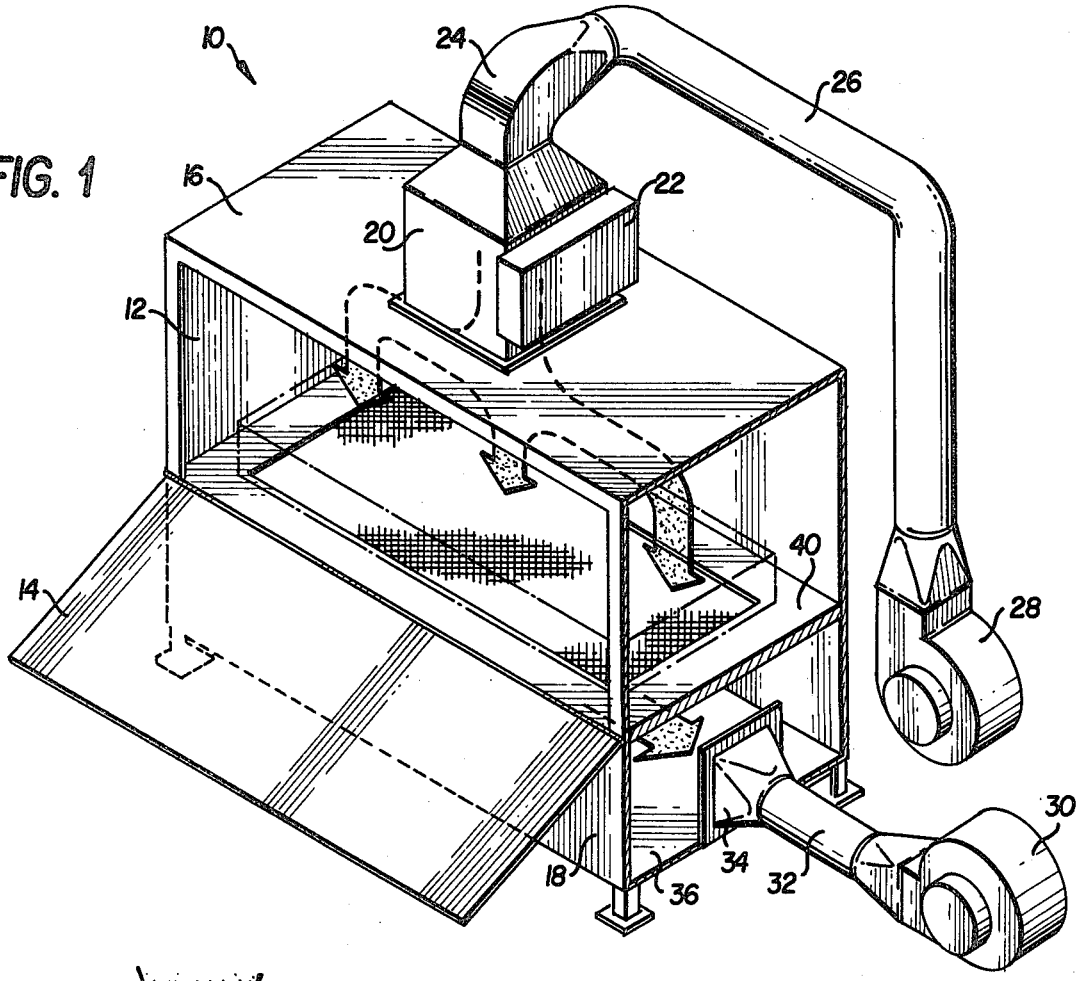
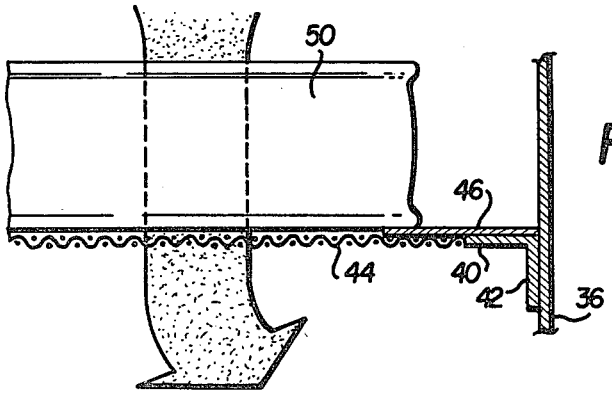
FIG. 2
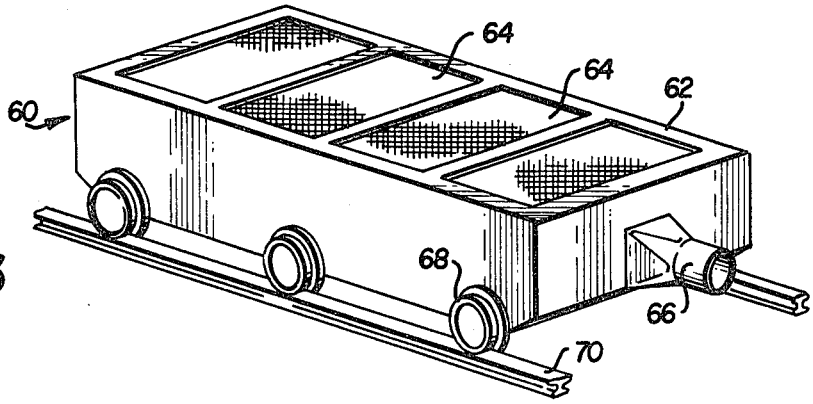
FIG. 3

FLOW-THROUGH DRYER AND METHOD FOR RAPID DRYING OF POROUS FOAMS

BACKGROUND OF THE INVENTION

1. Field of the Invention

This invention relates to a method and apparatus for rapidly drying a water laden porous or foraminous structure by passing heated air through the structure to remove the water.

2. Description of the Prior Art

Many foamed structures such as mattresses are made essentially dry from forms of polyurethane or from other polymers having little amounts of water present during their formation. As a result there has not been any drying problem when making these conventional products which would require removing large amounts of water.

Recently, hydrophilic polyurea-polyurethanes have been developed which are foamed by using large amounts of water. One example of this foam system is disclosed in Wood et al U.S. Pat. No. 4,137,200. These foams have many utilities. However, most of the uses of the foam require a final drying step to remove the water.

In addition, there has been concern about increasing the fire resistance of polyurethane foams to be used in cushions, mattresses and other similar fire susceptible foam structures. One way to make a more fire resistant foamed product is to mix this hydrophilic polyurea polyurethane prepolymer in about an equal amount with an aqueous slurry containing fire retardant additives. Examples of this system and useful additives are disclosed in U.S. Pat. Nos. 3,987,372 to Kehr et al, 4,066,578 to Murch et al, 4,165,411 to Marans et al and 4,230,822 to Murch et al. Again, the resulting foamed products contain a large amount of water which has been used to deliver the additives into the foam network. Similar structures made from latex-derived foams also have large amounts of water.

The problem presented is how to remove the water from these structures in a rapid, economical manner. One conventional method of drying these latex and polyurea-polyurethane foams involves placing them in a heated oven with air circulating around the foam pieces. Alternatively, the structures such as mattresses can be placed in a heated room for 24 to 72 hours or more to dry them out. These conventional techniques, however, require relatively long periods of time for drying which restricts the factory throughput when making each day many large structures such as mattresses.

Foam structures have also been dried by using radio frequency drying apparatus. However, for large foamed structures this technique is expensive in view of the substantial capital cost to purchase this equipment.

OBJECTS OF THE INVENTION

It is an object of this invention to achieve a method of rapidly drying foraminous structures.

It is a further object of this invention to rapidly dry porous fibrous composites and polymeric open celled foams by placing them in a heating chamber on a porous support while hot air is rapidly passed directly through the foam to dry the foam.

It is a further object of this invention to design an apparatus with a drying chamber for quick drying of foams where a foam structure can be placed on a porous support and the large quantities of hot air flowing through the drying chamber are directed by the support to essentially flow only through the porous foam structure.

It is a further object of this invention to have a drying apparatus with an impermeable mask arrangement around the foam structure so the heated air flowing through the chamber will only pass through the foam structure. The mask may be of fixed size or adjustable in dimensions to accomodate the sealing of porous structures of different sizes and shapes.

It is a further object of the invention to permit loading of the structures to be dried outside of the drying apparatus on a movable carrier which can be rolled into the drying chamber for drying.

These and further objects will become apparent as the description of the invention proceeds.

SUMMARY OF THE INVENTION

A porous foam containing substantial amounts of water can be rapidly dried by placing the foam in a specially designed drying chamber. The foam is placed over a porous support which has all of the area around the foam structure masked with an air impervious layer. When heated air is delivered to the inlet of the chamber all of the heated air will be directed to pass through the porous foam structure on the support so as to rapidly dry the foam. In the case of a foam mattress the time period is on the order of 1 hour or less.

When it is desired to dry multiple structures at the same time, a movable porous carrier optionally can be used which is loaded up outside the device and then rolled into the drying chamber.

BRIEF DESCRIPTION OF THE DRAWINGS

FIG. 1 is a pictorial view of the drying apparatus showing the inlet and outlet fans and the heated air flow with arrows.

FIG. 2 is a section view showing the air flow through a structure to be dried supported on the porous screen.

FIG. 3 is a pictorial view of another embodiment for drying more than one structure at a time.

DESCRIPTION OF THE PREFERRED EMBODIMENTS

FIG. 1 shows the preferred apparatus for the present invention when drying one object at a time. The drying device consists of the unit 10 having an upper drying chamber 12 with a hinged door 14 which can open to insert the wet foamed structure into the device. Wall 16 forms a roof on the top of this upper drying chamber. A lower chamber 18 serves as a plenum chamber to remove the wet gas from the object being heated.

The roof 16 on the upper drying chamber supports an inlet plenum 20 with an air heater inside and with an adjacent control box 22. On top of that chamber is the coupling element 24 connecting the inlet plenum 20 and the inlet air line 26 which in turn is connected to the inlet fan or blower 28.

To assist in removing the moisture ladden air from the device an exhaust fan or blower 30 can be connected to the bottom plenum chamber 18 via an exhaust line 32 which connects to the exhaust coupling 34 on the wall 36 of the bottom chamber. Although this is the preferred embodiment, it is not necessary to use both the inlet and the exhaust blower since either one alone can be used to force the heated air through the device.

A porous floor element 40 divides the upper and lower chambers and supports the object to be dried. The flow of the gas through the device and downward through the object is shown by the phantom arrows in FIG. 1.

FIG. 2 provides a detailed view of the relationship between the floor 40 and the object 50 being dried. As seen in that figure, the floor 40 can be secured to the side wall 36 by a flange element 42. The central part of the floor consists of a porous screen 44. An impermeable mask element 46 can be placed down on top of the screen to define a smaller cross-sectional area than the object 50 to be dried. This will provide a sealed off perimeter to insure that all of the air passing through the upper drying chamber will only pass through the object 50. Without the mask the air would flow around the object along a path of least resistance. The mask may be of fixed size or adjustable in dimensions to accomodate the sealing of porous structures of different sizes and shapes.

A further embodiment of the invention for drying multiple objects simultaneously is exemplified but not limited by the design as shown in FIG. 3. In this embodiment a rolling support chamber 60 is used. The chamber has a top supporting wall 62 with cut out portions exposing porous screens 64. Each of these cut out screened portions are such that the object being placed on top will have a larger surface area in contact with the screen than the surface area of the screened opening. The cut out screened portions can be fabricated in at least two ways. One would be to have a porous screen over the entire top of the chamber 60 and to place over it a mask with the appropriate cut-outs of a size slightly smaller than the area of the structures being dried. The second possible procedure would be to cut out of the top wall a series of openings with the appropriate size and to then put screens across these cut-out openings.

This rolling support chamber 60 has an outlet exhaust connection 66 at one end. The chamber has wheels 68 which can ride on a track 70 or the wheels could be conventional rubber wheels riding on a flat floor. In this preferred embodiment the track extends from outside the device through an opening into and below the drying chamber. In effect, this embodiment consists of putting wheels on the lower chamber 18 and floor 40 of the device of FIG. 1 and making it possible for this supporting structure to roll out of the drying chamber. This embodiment also involves making the entire device larger to handle the increased number of objects to be dried. When the device is made larger, then it is also possible to use separate inlet ports centered over each of the objects being dried to direct the hot air directly onto each of the objects.

In operation, the objects or structures to be dried are placed on top of the screens 64 outside the drying device. The rolling support chamber is then rolled into the drying device. An exhaust line is connected to the outlet connecting element 66 which in turn can be connected to the exhaust fan or blower 30 shown in FIG. 1. The air heater is turned on as well as both the inlet and outlet fans in the preferred embodiment. As the heated air passes down through the objects it picks up water and continues through the screens into the lower chamber and out the outlet 66 to the exhaust fan.

It is within the scope of this invention to provide larger or smaller units for drying porous objects than exemplified in FIGS. 1–3. When drying a large quantity of objects, the drying unit may optionally be comprised of compartments each of which contain one or more porous objects to be dried. These compartments may be disposed in a horizontal or vertical stacking mode (or both) and each compartment may be provided with inlet and outlet gas flow means connected to one or more sources of heated air.

Having described the basic aspects of our invention, the following examples are given to illustrate specific embodiments thereof.

EXAMPLE 1

A 45 pound mattress made of an open cell flexible polyurea polyurethane and containing approximately 12 pounds of water was placed in a drying chamber according to the present invention illustrated in FIG. 1. The mattress was 76 inches long, 30 inches wide and 3 inches deep. The approximate dimensions of the drying chamber were 84 inches long, 36 inches wide and 18 inches high. An air impervious mask was placed beneath the mattress on the porous support and it surrounded the mattress to prevent air from passing around the mattress. Air heated to a temperature of 167° F. was passed through at the rate of 540 cubic feet per minute (cfm). The mattress was dried in 45 minutes to the point where the mattress contained less than 5% water.

Previously, such a mattress when placed in a warm room at a temperature of about 120° F. required approximately 24 hours for the mattress to be completely dried.

EXAMPLE 2

Using the same apparatus as in Example 1, a mattress weighing 47 pounds was dried to 35 pounds (5% of total weight being water) during a period of 35 minutes by passing 540 cfm of air heated to 194° F.

What is claimed is:

1. An apparatus for drying foraminous structures comprising a drying chamber with means to permit entry and exit of the structure to be dried;

a gas inlet means on one side of the chamber;

a gas outlet means on said chamber spaced apart from said gas inlet means and the outlet of which is open to the atmosphere;

a heated gas supply means adapted to supply heated gas to the gas inlet means;

a support means in said drying chamber between the gas inlet means and the gas outlet means to support the structure to be dried;

gas directing means in said drying chamber to direct the gas flowing through the chamber to essentially pass only through the foraminous structure; and means to circulate heated gas through the chamber and out the outlet means whereby water is removed from the foraminous structure and it is dried.

2. An apparatus according to claim 1, wherein the means to permit entry and exit of the structure is a door with means to close the door in an airtight position.

3. An apparatus according to claim 1, wherein said gas directing means comprises a gas-impervious mask adjacent the support means and surrounding the structure to be dried to direct all of the heated gas to flow through the structure.

4. An apparatus according to claim 1, wherein said support means is a stationary screen.

5. An apparatus according to claim 1, wherein the means to circulate the heated air is an inlet air fan.

6. An apparatus according to claim 5, further comprising an exhaust fan connected to the gas outlet means.

7. An apparatus according to claim 1, wherein the means to circulate the heated air is an exhaust fan connected to the gas outlet means.

8. An apparatus according to claim 1, wherein said support means comprises a movable support chamber which is movable into the bottom of the drying chamber, said support chamber being adapted to have at least one structure being dried placed on top of the support chamber and said gas outlet means extending from said support chamber.

9. An apparatus according to claim 8, wherein said support chamber has wheels to roll it into and out of the drying chamber.

10. An apparatus according to claim 9, wherein said wheels are adapted to ride on rails into the drying chamber.

11. A batch process method of rapidly drying foraminous structures by forcing heated air through the structure in a drying chamber comprising inserting said structure to be dried onto a flat porous support member in the drying chamber positioned between a heated gas inlet and a gas outlet, said support member having a gas impervious mask around the perimeter outside of the area of said structure;

circulating heated air rapidly through said chamber so that essentially all of the heated air passes through said structure and then exhausting said heated air to the atmosphere until said structure is dried; and removing the dried structure from the drying chamber.

12. The method of claim 11, wherein the foraminous structure comprises a porous foam.

* * * * *